US005513483A

United States Patent [19]

Tipton et al.

[11] Patent Number: 5,513,483

[45] Date of Patent: May 7, 1996

[54] CONTINUOUSLY ADJUSTABLE STRAPPING MACHINE

[75] Inventors: Allison D. Tipton, Bloomingdale; Keith A. Cahill, West Dundee, both of Ill.

[73] Assignee: Illinois Tool Works Inc., Glenview, Ill.

[21] Appl. No.: 381,249

[22] Filed: Jan. 31, 1995

[51] Int. Cl.[6] ..... B65B 13/04

[52] U.S. Cl. ..... 53/589; 53/582; 100/26

[58] Field of Search ..... 100/25, 26, 27; 53/588, 589, 582, 201

[56] References Cited

U.S. PATENT DOCUMENTS

| | | | |
|---|---|---|---|
| 2,844,091 | 7/1958 | Shafer et al. | 53/589 X |
| 3,220,337 | 11/1965 | Goland et al. | 53/589 |
| 3,221,642 | 12/1965 | Ayres | 100/27 |
| 4,282,700 | 8/1981 | Goldstein | 53/588 X |
| 4,823,686 | 4/1989 | Fleissner | 100/26 |
| 5,218,813 | 6/1993 | Seidel | 53/589 X |

OTHER PUBLICATIONS

Baldwin Vertical Stacker Bundler Series brochure LPIM Sep. 1992.

SMC, division of Butler Automatic, Inc. Model: V-3500 Series brochure, Aug. 1993.

*Primary Examiner*—Linda Johnson
*Attorney, Agent, or Firm*—Schwartz & Weinrieb

[57] ABSTRACT

A strapping machine having a base plate with a pivoting member pivotably hinged on a front portion of the base plate. A turnbuckle interconnects the pivoting member and the base plate to adjust the position of the pivoting member relative to the base plate. A strap feed and take-up mounting member is adjustably mounted up and down along the pivoting member, and a strap feed and take-up assembly is mounted on a mounting surface of the strap feed and take-up mounting member. A chute having a rectangular frame with a channel for receiving a strap from the strap feed and take-up assembly is coupled to the strap feed and take-up assembly, wherein the chute is pivotably adjustable in relation to the base plate, and wherein the chute is adjustable up and down along the pivoting member. Removable wheel mounting bars are disposed on the front and rearward portions of a bottom surface of the base plate, and each wheel mounting bar includes casters disposed on opposite ends thereof by a shoulder screw.

13 Claims, 3 Drawing Sheets

CONTINUOUSLY ADJUSTABLE STRAPPING MACHINE

FIELD OF THE INVENTION

The present invention generally relates to an adjustable strapping machine, and in particular to a strapping machine with an adjustable chute usable in combination with different types of stacking machines and for stand alone operation.

BACKGROUND OF THE INVENTION

Strapping machines are often used in combination with a stacking machine which forms a stack of articles, usually paper, in a uniform stack which is compressed and then securely bundled with a strap. Generally, stacking machines feed the articles to be stacked to a rack movably disposed along an inclined surface where the articles accumulate to form the uniform stack. After the stack reaches a specified height, the stack is compressed and positioned on a conveyor below the rack, all the while maintained on the inclined surface. A strapping machine, positioned on a track of the stacking machine, has a chute disposed around the conveyor of the stacking machine, wherein the strap is fed through the chute and then tensioned and secured about the stack of articles. Stacking machines are well known, and the marketplace teems with competitors each having machines with distinct parameters which must be accommodated by the strapping machine for compatible use therewith. For example, the inclined surface along which the stack is formed varies from one stacking machine to another over an angular range between approximately 5 and 35 degrees measured from a vertical reference. The conveyors also have different heights above ground level. In order for a strapping machine to be compatible for use with a stacking machine, the chute of the strapping machine must be oriented at the same angle as the inclined surface of the stacking machine, and must be positioned at a correspondingly appropriate height above ground level. Further, the track of the stacking machine, which permits the strapping machine to be moved in and out of its operating position for servicing, varies in width or gauge from one stacking machine to the next. Still further, stacking machines of a given manufacturer have parameters that vary within a specified tolerance range, and these variable parameters often require that compensating fine adjustments be made when assembling a prior art strapping machine with a stacking machine. Therefore, in the past, each strapping machine has been uniquely manufactured for compatibility with the parameters of the specific type stacking machine with which it will be used.

In view of the discussion above, there exists a demonstrated need for an advancement in the art of strapping machines, and in particular for a novel strapping machine that may be adjusted in the field to satisfy the parameters of any one of several different types of stacking machines.

OBJECTS OF THE INVENTION

It is therefore an object of the present invention to provide a novel adjustable strapping machine.

It is also an object of the present invention to provide a novel adjustable strapping machine that is economical to manufacture and use.

It is another object of the present invention to provide a novel strapping machine with a chute mounted on a pivoting member that may be continuously adjusted so as to vary the angle of the chute to correspond with an inclined stacking surface of a stacking machine and which may also be adjusted for stand alone operation.

It is a further object of the present invention to provide a novel strapping machine with a chute mounted on a mounting plate continuously adjustable up and down along the pivoting member so as to vary the height of the chute to correspond with the height of a conveyor of the stacking machine.

It is a yet another object of the present invention to provide a novel strapping machine with a wheel mounting assembly that may be readily interchanged to permit the strapping machine to operate on stacking machines with different track widths.

SUMMARY OF THE INVENTION

Accordingly, the present invention is directed toward a novel strapping machine having a pivoting member pivotably hinged on a front portion of a base plate. A turnbuckle interconnects a fixed cross brace of the pivoting member and the base plate to permit continuous adjustment of the pivoting member relative to the base plate. The pivoting member includes a cross member having end portions adjustably fastened to a pair of tubular members by a corresponding fastener extending into one of a series of regularly spaced holes in the tubular members. A strap feed and take-up mounting member includes a mounting plate with a flange on opposite sides thereof, and is continuously adjustable up and down along the pivoting member. Each flange has a slot through which a second fastener is extended into one of a second series of holes in the tubular members of the pivoting member. A second mounting member is disposed on the mounting plate and includes an adjustment bolt extending through the second mounting member and impinging on the adjustable cross member so as to continuously adjust the strap feed and take-up mounting member up and down along the tubular members of the pivoting member. A strap feed and take-up assembly is mounted on the mounting plate of the strap feed and take-up mounting member. A chute having a rectangular frame with a channel for receiving a strap from the strap feed and take-up assembly is coupled to the strap feed and take-up assembly, wherein the chute is pivotably adjustable in relation to the base plate, and wherein the chute is adjustable up and down along the pivoting member. The chute includes a rectangular frame with linear portions having an I-shaped member with an end portion. Strips with a flanged portion extendable over the end portion of the I-shaped member form a channel through which a strap is fed. The strips are movably retained on opposite sides of the I-shaped member, and are biased toward the I-shaped member so as to retain the strap in the channel during feeding of the strap. The strips are movable away from the I-shaped member so as to release the strap from the channel during tensioning of the strap. Also, removable wheel mounting bars are disposed on the front and rearward portions of a bottom surface of the base plate, and each wheel mounting bar includes casters disposed on opposite ends thereof by a shoulder screw.

BRIEF DESCRIPTION OF THE DRAWINGS

These and other objects, features and advantages of the present invention will become apparent upon consideration of the following Detailed Description of the Invention with the accompanying drawings, in which like reference characters designate like or corresponding parts throughout the several views, and wherein.

DETAILED DESCRIPTION OF THE INVENTION

Figure 1:
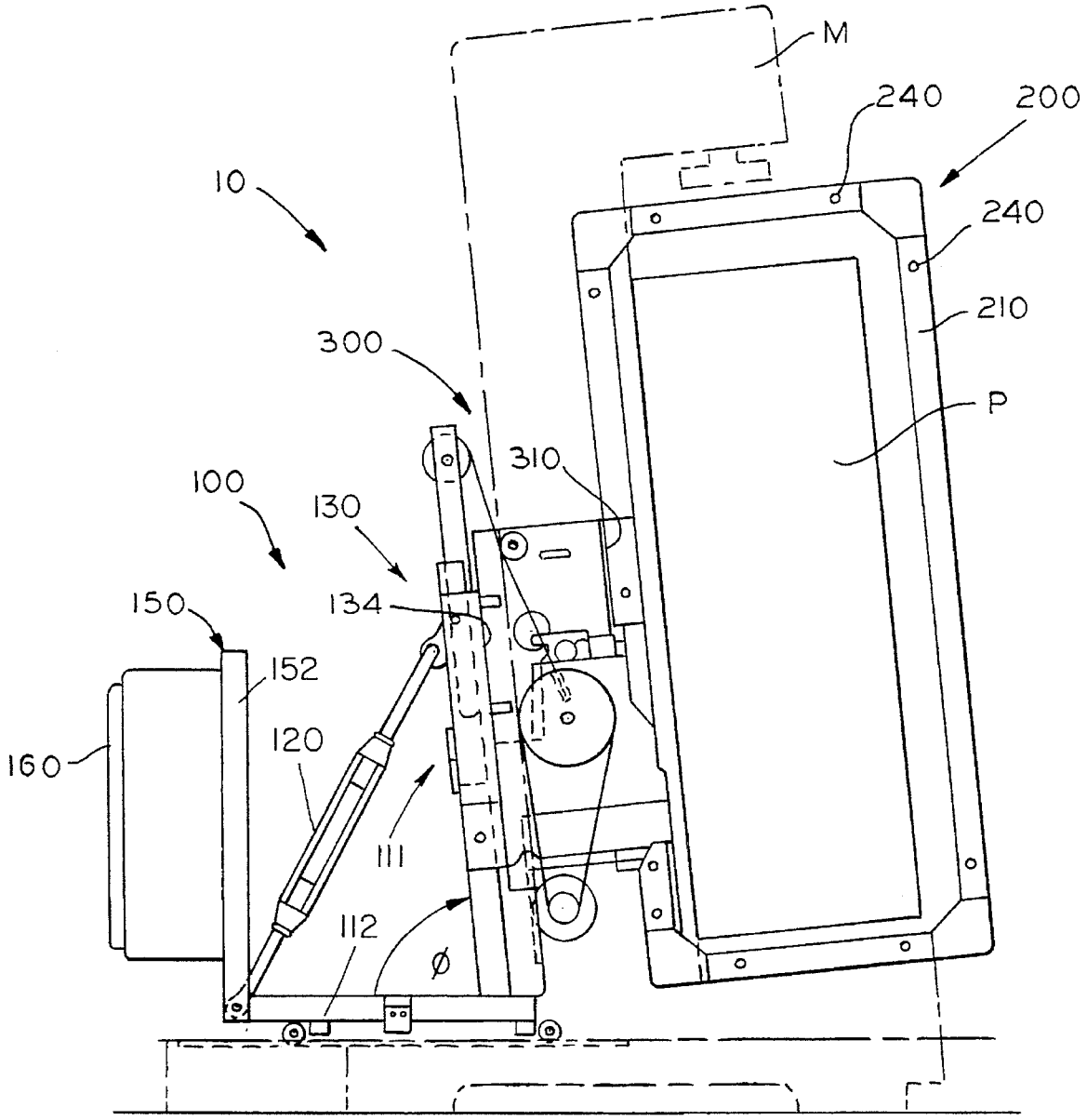
FIG. 1 is side view of an embodiment of a strapping machine according to the present invention.

FIG. 1 is a side view of a strapping machine 10 generally comprising an adjustable frame 100 coupled to a strap chute assembly 200, and including a strap feed and take-up assembly 300 for feeding a strap through the strap chute assembly and tensioning the strap about a package P. In one embodiment, the strapping machine 10 is positioned in relation to a stacking machine M, shown in broken lines, but those skilled in the art will appreciate that the strapping machine of the present invention may also be used for stand alone operation in the absence of a stacking machine as further discussed below.

Figure 2:
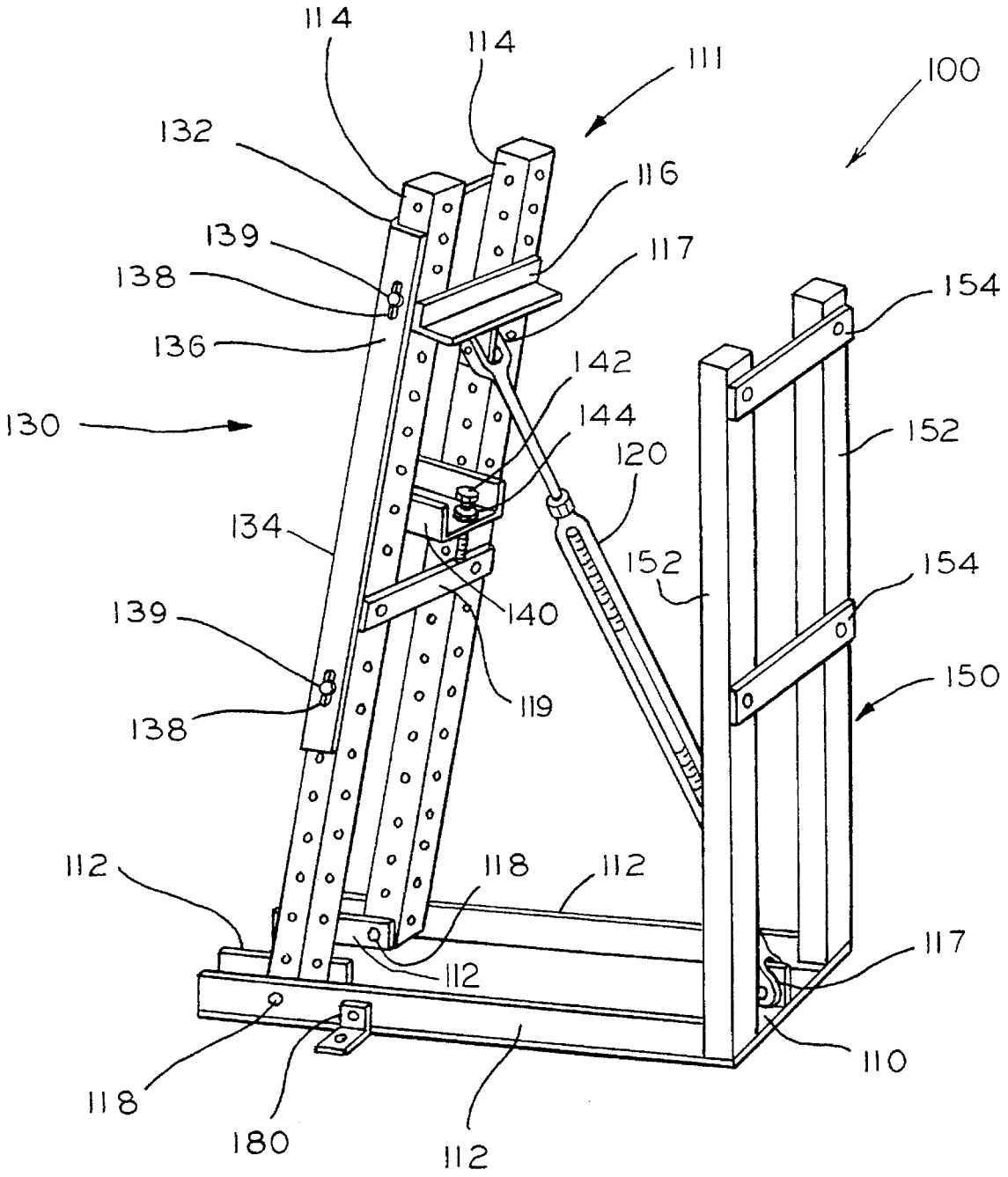
FIG. 2 is a partial perspective view of a continuously adjustable frame of the strapping machine of the present invention.

FIG. 2 is a partial perspective view of the adjustable frame 100 of FIG. 1 including a base plate 110 with a pivoting member 111 for adjusting the angular position of the chute assembly 200 in relation to the base plate 110. The base plate 110 includes a pair of inner and outer mounting flanges 112 disposed on an upper surface of the base plate, wherein in one embodiment, the outer mounting flanges extend along substantially the entire length of the opposite lateral sides of the base plate. The pivoting member 111 is pivotally mounted to the mounting flanges 112 of the base plate. The pivoting member 111 includes a pair of tubular members 114 having a series of regularly spaced holes extending through opposite sides thereof, which in one embodiment are spaced at one inch intervals. The tubular members 114 are each coupled to the mounting flanges 112 by a pivot 118 comprised of a pin or a bolt or other means known in the art, which extends through the inner and outer flanges 112 and through the tubular members 114, and may include washers disposed between the moving surfaces to prevent binding and facilitate the pivoting motion of the pivoting member 111. The tubular members 114 include a fixed cross brace 116, and an adjustable cross member 119 which may be adjustably positioned up or down along the length of the tubular members 114 by means of a bolt extending therethrough and through one of the holes of each one of the tubular members 114. A turnbuckle 120 interconnects the cross brace 116 and a rearward portion of the base plate. In one embodiment, the base plate 110 and the cross brace 116 each include a corresponding mounting flange 117 extending therefrom, and preferably symmetrically located in relation to the tubular members 114 and the base plate. The turnbuckle 120 is pivotally mounted to the mounting flanges 117 by a pivot pin, and permits angular adjustment of the pivoting member 111 in relation to the base plate 110 in a range between approximately 65 and 90 degrees as measured by an angle $\phi$ of FIG. 1, wherein the lower portion of the chute assembly 200 is parallel with the base plate 110 when the pivoting member 111 is in the 90 degree position.

The adjustable frame 100 also includes a feed and take-up assembly mounting member 130 adjustably mounted to the pivoting member 111 for positioning the chute assembly 200 up or down along the pivoting member 111. The mounting member 130 includes a mounting plate 132 with a mounting surface 134 on which is mounted the strap feed and take-up assembly 300. Flanges 136 are disposed upon opposite lateral side portions of the plate 132 to form a U-shaped member that is mounted on the tubular members 114 of the pivoting member 111. The flanges 136 include one or more slob 138 through which a fastening member 139 extends to securely fasten the mounting member 130 to the pivoting member 111. In one embodiment, the fastening member 139 is a bolt that extends through the flanges and through the holes in the tubular members 114, and is secured by a removable nut or other means known in the art. The mounting member 130 also includes a flange 140, which in one embodiment has a sectional U-shape for strength, fixedly mounted on a surface opposite the mounting surface 134, and which is positioned between the tubular members 114 and extends over the adjustable cross member 119. An adjustment bolt 142 extends through the flange 140 and impinges on the cross member 119 to freely adjust the position of the mounting member 130 in relation to the tubular members 114 within the range allowed by the slob 138, which in one embodiment is +/−0.5 inches, upon loosening the fastening members 139. A nut 144 is included on the bolt 142 to lock the bolt in its final position, and the fastening members 139 are tightened to further secure the mounting member 130 to the pivoting member 111. The mounting member 130 is adjustably re-positioned on the pivoting member 111 by temporarily removing the fasteners of the mounting member 130 and cross member 119, and re-positioning the mounting member 130 and the cross member 119 up or down along the tubular members 114 as discussed above. In one embodiment, the pivoting member 111 is positioned so that a lower portion of the chute assembly 200 is positioned parallel with a floor surface, and the mounting member 130 is lowered in relation to the pivoting member 111 to recess the lower portion of the chute assembly in a channel of the floor, not shown in the drawing, so that a package may readily be disposed within the chute by a forklift or other means known in the art.

FIG. 2 illustrates a vertical support member 150 fixedly mounted on a rearward portion of the base plate 110, which in one embodiment is formed of two tubular members 152 extending from the base plate 110 and connected by one or more cross members 154. An electrical cabinet 160 is supported by the vertical members 150 by means of bolts extending through the cross members 154 or directly into the tubular members 152. The cabinet 160 contains electrical equipment for operating the strapping machine, and may also serve as a counterweight to balance the weight of the strap feed and take-up assembly 300 mounted on the mounting member 130. The electrical cabinet 160 generally includes power supply and control means with a control signal input cable for receiving control signals and a control output cable to control the strap feed and take-up assembly 300. In one embodiment, the electrical cabinet 160 includes an illuminated power "ON/OFF" switch for powering the strap feed and take-up assembly 300, a "JOG FEED" and "JOG TAKE-UP" switch for incrementally feeding and taking-up the strap in the chute assembly 200, and a "MANUAL STRAP CYCLE" switch for manually cycling the strap feed and take-up assembly 300.

Figure 3A:
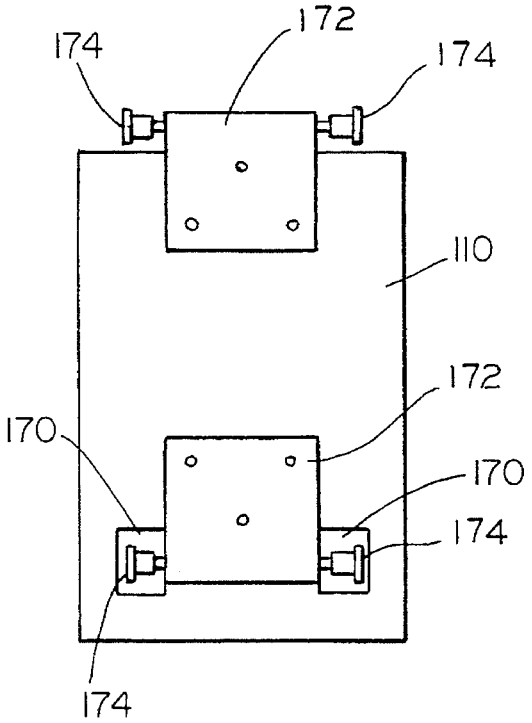
FIG. 3*a* is a partial bottom view of one embodiment of a base plate of the adjustable frame of the present invention.
Figure 3B:
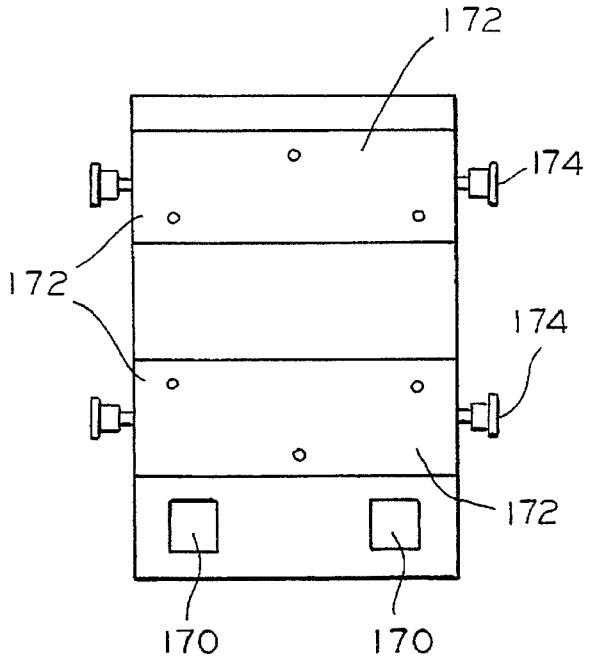
FIG. 3*b* is a partial bottom view of another embodiment of a base plate of the adjustable frame of the present invention.

FIG. 3 is a partial bottom view of the base plate 110, and illustrates a wheel mounting bar 172 fixed by bolts extending through the bar and into corresponding threaded holes formed within the bottom surface of the base plate 110 at both the rearward and front end portions thereof. Each wheel mounting bar 172 generally includes a caster 174 disposed on opposite sides thereof by a shoulder screw and one or more interposing washers. According to the present invention, the base plate 110 is readily configured with one of several different types of wheel mounting bars and caster assemblies to operate on different gauge tracks or on a flat surface or a combination of both. In the embodiment of FIG. 3*a*, the width of the mounting bar 172 is narrower than the width of the base plate 110, and the casters are mounted toward an end portion of the mounting bar, whereby the casters located at the rearward portion of the base plate 110 are located in recesses 170, and an identical wheel mounting bar and caster assembly is mounted on the opposite end of the base plate 110 by flipping the assembly so that the casters extend out in front of the base plate. In the alternative embodiment of FIG. 3*b*, the wheel mounting bar 172 has a width which is substantially the same as the width of the base plate and the casters extend out along the lateral sides of the base plate 110. In another embodiment, the casters on both sides of the base plate roll on a track not shown in the drawing, and in these embodiments the casters may be grooved or may have an outer flange to ensure that the casters remain on the track. In another embodiment, the casters on one side of the base plate are grooved to roll on a track, and the casters on the opposite side of the plate roll on a flat surface. The base plate 110, therefore is readily configured and re-configurable to operate on any gauge track or on a flat surface as a given application may require by merely removing and replacing the wheel mounting bar and caster assemblies. As shown in FIG. 2, the base plate 110 also includes one or more brackets 180 mounted on the outside flange 112, and in one embodiment, the bracket 180 extends below the lower surface of the base plate 110, for securing the adjustable frame 100 in its operative position in relation to a stacking machine or on a floor at an operation site. In one embodiment, a pin extends through a hole in the bracket and into a corresponding hole of the operation site. In another embodiment, the adjustable frame 100 does not include casters, but is removably mounted at its operative site by bolts extending through several brackets 180 arranged on one or both sides of the base plate.

Figure 4:
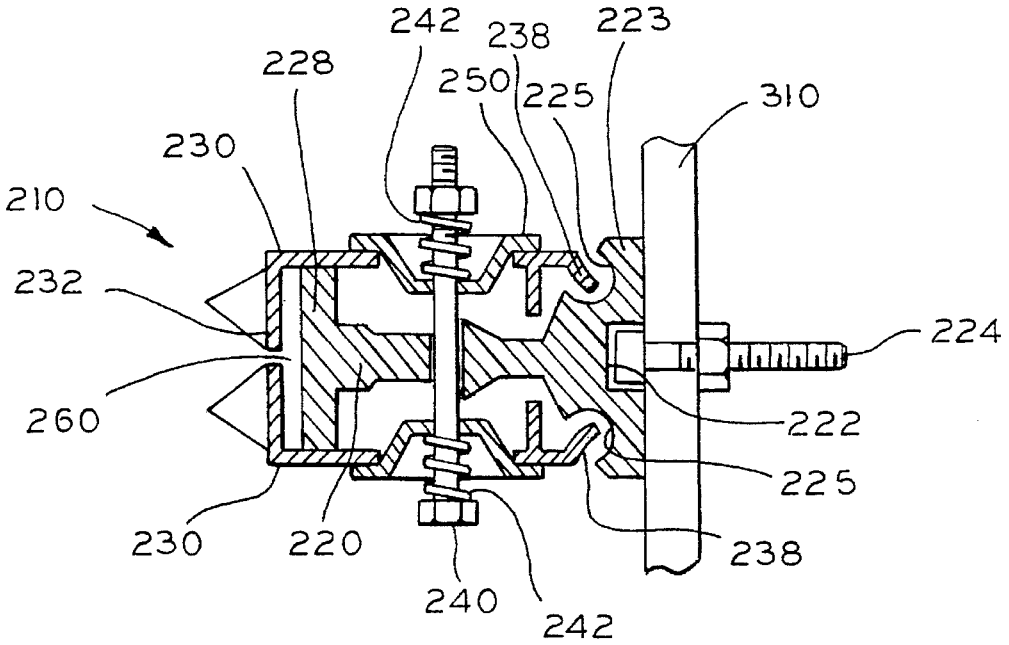
FIG. 4 is a sectional view of a linear portion of a chute assembly of the present invention.

The strap chute assembly 200 generally comprises a rectangular frame 210 mounted to a bracket 310 of the strap feed and take-up assembly 300. FIG. 4 is a sectional view along a linear portion of the frame 210 having a substantially I-shaped member 220 with a grooved channel 222 on a mounting portion 223 for receiving and retaining a head of a bolt 224 which permits a threaded portion of the bolt to extend from the frame 210, and into a hole through the bracket 310 where it mates with a nut, and is tightened to draw the frame into secure contact with the bracket. In one embodiment, several bolts secure the frame 210 of the chute assembly 200 to the bracket 310 of the feed and take-up assembly 300. In another embodiment, the bolts are secured by a quick release nut assembly for readily disengaging the chute assembly 200 from the bracket 310. Strips 230 are movably retained on opposite sides of the I-shaped member 220 by a bolt 240 extending through a hole in the strips 230 and a hole in the I-shaped member 220. The strips are biased toward and against the I-shaped member 220 by springs 242, one of which is disposed between a head of the bolt and an outer surface of the strip and the other one being disposed between a nut and an outer surface of the opposing strip. In one embodiment, the strips 230 include a recessed plug 250 frictionally engaged and retained in a hole in the strips 230, wherein the bolt extends through a hole located in the recessed portion of the plug which also forms a seat for each spring 242. The strips 230 include a flange portion 232 extending over an end portion 228 of the I-shaped member to form a channel 260 through which the strap is fed by the feeding and tensioning assembly. The flange portions 232 of the strips 230 are movable away from the opposite sides of the I-shaped member 220, against the bias of the springs 242, to permit the strap to be removed from the channel 260 when the feeding and take-up assembly 300 applies a tension to the strap. The flange portions 232 are separated as the strap is subjected to a tensioning force by the strap feeding and take-up assembly 300. The mounting portion 223 includes recesses 225 on opposite sides thereof for receiving ranged portions 238 of the strips 230, which tend toward each other when the flange portions 232 are seperated from the I-shaped member 220 to release the strap. The linear portions of the frame are coupled by comer portions which permit continuity of the strap channel 260 between connecting linear portions.

The foregoing is a description enabling one of ordinary skill in the art to make and use the preferred embodiments of the present invention. It will be appreciated by those skilled in the an that there exists variations, modifications and equivalents to the embodiments disclosed herein. The present invention therefore is to be limited only by the scope of the appended claims.

What is claimed is:

1. A strapping machine, comprising:

a base plate;

a pivoting member pivotably mounted upon one side of said base plate so as to be pivotably adjustable with respect to said base plate and thereby define a first mode of movement with respect to said base plate;

a strap feed and take-up mounting member adjustably mounted upon said pivoting member so as to be translationally adjustable in a substantially vertical direction along said pivoting member with respect to said base member and thereby define a second mode of movement with respect to said base plate;

a strap feed and take-up assembly mounted upon said strap feed and take-up mounting member and therefore able to undergo first and second modes of movements with respect to said base plate as said pivoting member undergoes said pivotable movement with respect to said base plate, and said strap feed and take-up mounting member undergoes said translational movement with respect to said base plate; and a chute having a frame with a channel for receiving a strap from said strap feed and take-up assembly, and being fixedly connected to said strap feed and take-up assembly so as to be pivotably adjustable with respect to said base plate in accordance with said first mode of movement as said pivoting member pivots with respect to said base plate, and be vertically adjustable along said pivoting member and with respect to said base plate in accordance with said second mode of movement as said strap feed and take-up mounting member is vertically adjusted along said pivoting member.

2. The strapping machine of claim 1, further comprising:

a pair of tubular members, respectively connected to said base plate by pivot means, and connected together by a fixed cross brace comprise said pivoting member; and a turnbuckle pivotably connected at one end to said fixed cross brace of said pivoting member, and pivotably connected at an opposite end to said base plate, whereby said pivoting member is continuously adjustable with respect to said base plate by adjusting said turnbuckle.

3. The strapping machine of claim 2, further comprising:

a first series of equally spaced holes defined within each one of said pair of tubular members;

a cross member having end portions thereof adjustably fastened to each one of said tubular members by a fastener inserted into one of said first series of equally spaced holes defined within said tubular members;

a second series of equally spaced holes defined within each one of said pair of tubular members;

a flange mounted upon each opposite side of said strap feed and take-up mounting member wherein each flange has a slot defined therein through which a second fastener is able to be inserted into one of said second series of holes defined within said tubular members such that said strap feed and take-up mounting member is able to be continuously vertically adjustable along said tubular members of said pivoting member;

a bracket fixedly mounted upon said strap feed and take-up mounting member; and an adjustment bolt adjustably mounted within said bracket and engaging said cross member so as to continuously adjust said strap feed and take-up mounting member vertically along said tubular members of said pivoting member.

4. The strapping machine of claim 1, further comprising:

a pair of wheel mounting bars disposed upon said base plate; and a plurality of casters mounted upon said wheel mounting bars for permitting said strapping machine to be transported upon a support surface.

5. The strapping machine of claim 1, further comprising:

a vertical support member fixedly mounted upon said base plate for supporting an electrical cabinet containing electrical components for enabling operation of said strapping machine.

6. The strapping machine of claim 1, wherein:

said frame of said chute comprises an I-shaped member;

strips movably retained upon opposite sides of said I-shaped member and having flange portions disposed over an end portion of said I-shaped member so as to form said channel through which said strap is fed; and means for biasing said strips toward said I-shaped member so as to retain said strap within said channel and yet permit said strips to be moved away from said I-shaped member so as to release said strap from said channel.

7. The strapping machine of claim 6, further comprising:

a bolt extending through a hole provided within each one of said strips and through a hole provided within said I-shaped member; and said means for biasing said strips toward said I-shaped member comprises a pair of springs disposed upon said bolt.

8. The strapping machine of claim 7, wherein:

said I-shaped member includes a mounting portion at an opposite end portion thereof with a grooved channel for receiving a head portion of a bolt and wherein a threaded portion of said headed bolt extends from said mounting portion of said I-shaped member into said strap feed and take-up assembly so as to mount said chute onto said strap feed and take-up assembly; and said mounting portion of said I-shaped member further comprises recesses upon opposite sides thereof for receiving portions of said strips which tend toward one another when said flanged portions of said strips are separated from each other so as to release said strap.

9. The strapping machine of claim 4, wherein the casters extend beyond lateral side portions of the base plate.

10. The strapping machine of claim 4, further comprising:

caster recesses defined within first portions of said base plate for housing a first pair of said casters; and a second pair of said casters extend beyond an edge portion of said base plate.

11. The strapping machine as set forth in claim 1, further comprising:

bracket means fixedly mounted upon said base plate; and fastener means inserted through said bracket means for fixing said strapping machine at a predetermined position upon a support surface.

12. The strapping machine as set forth in claim 3, wherein:

said tubular members have substantially rectangular cross-sectional configurations; and said first and second series of equally spaced holes are defined within adjacent sides of said substantially rectangularly configured tubular members.

13. The strapping machine as set forth in claim 1, wherein:

said pivoting member can pivot with respect to said base plate through an angular range of 65°–90°.

* * * * *